US006740019B2

(12) United States Patent
Bois

(10) Patent No.: US 6,740,019 B2
(45) Date of Patent: May 25, 2004

(54) METHOD OF MANUFACTURING BAGS HAVING COMPLEMENTARY CLOSURE STRIPS, A MANUFACTURING MACHINE, AND BAGS OBTAINED THEREBY

(75) Inventor: Henri Georges Bois, Neuilly sur Seine (FR)

(73) Assignee: Flexico France (FR)

( * ) Notice: Subject to any disclaimer, the term of this patent is extended or adjusted under 35 U.S.C. 154(b) by 0 days.

(21) Appl. No.: 10/060,207

(22) Filed: Feb. 1, 2002

(65) Prior Publication Data

US 2002/0107130 A1 Aug. 8, 2002

(30) Foreign Application Priority Data

Feb. 2, 2001 (FR) ..... 01 01457

(51) Int. Cl.[7] ..... B65D 33/25; B65D 33/34

(52) U.S. Cl. ..... 493/156; 493/214; 53/456; 53/459; 53/471; 53/550

(58) Field of Search ..... 53/456, 459, 471, 53/412, 550, 485, 567, 133.4, 139.2; 493/214, 156; 383/63, 64

(56) References Cited

U.S. PATENT DOCUMENTS 3,554,822 A * 1/1971 Schwarzkopf ..... 156/66
3,988,184 A * 10/1976 Howard ..... 156/66
4,555,282 A * 11/1985 Yano ..... 156/66
4,666,536 A * 5/1987 Van Erden et al. ..... 156/64
4,876,842 A * 10/1989 Ausnit ..... 53/410
4,909,017 A * 3/1990 McMahon et al. ..... 53/410
5,046,300 A * 9/1991 Custer et al. ..... 53/412
5,215,380 A * 6/1993 Custer et al. ..... 383/203
5,776,045 A * 7/1998 Bodolay et al. ..... 493/215
5,884,452 A * 3/1999 Bois ..... 53/412
6,003,582 A 12/1999 Blohowiak et al.
6,032,437 A * 3/2000 Bois ..... 53/412
6,477,821 B1 * 11/2002 Bois ..... 53/412
6,516,850 B1 * 2/2003 Blohowiak et al. ..... 156/352

FOREIGN PATENT DOCUMENTS

WO WO 00/76872 A1 12/2000

* cited by examiner

*Primary Examiner*—Rinaldi I. Rada
*Assistant Examiner*—Brian D. Nash
(74) *Attorney, Agent, or Firm*—Finnegan, Henderson, Farabow, Garrett & Dunner, L.L.P.

(57) ABSTRACT

The present invention relates to a method of manufacturing bags including complementary closure strips, the method comprising the steps consisting in: separately feeding a film and closure strips having sequential thin zones at the same pitch as the bags; and fixing the strips to the film; the method further comprising the steps consisting in: detecting loss of synchronization between the closure strips and means acting in the assembly station; and in the event of loss of synchronization being detected, modifying the size of the sequential thin zones provided in the strips so as to reestablish synchronization. The present invention also relates to a machine for implementing the method, and to the bags obtained thereby.

50 Claims, 1 Drawing Sheet

METHOD OF MANUFACTURING BAGS HAVING COMPLEMENTARY CLOSURE STRIPS, A MANUFACTURING MACHINE, AND BAGS OBTAINED THEREBY

The present invention relates to the field of bags including complementary closure strips designed to enable a user to open and close the bag on successive occasions.

BACKGROUND OF THE INVENTION

Numerous types of bag and/or closure strip have already been proposed for this purpose.

The present invention applies in particular to bags whose closure strips are opened and closed by means of a slide.

Still more precisely, the present invention relates to bags made from a film plus closure strips which are fed separately to an assembly station where the closure strips are fixed onto the film.

Numerous methods and machines have been proposed for this purpose.

Nevertheless, the person skilled in the art has long been aware that making bags using such means often raises a major difficulty: the thickness of the closure strips brought onto the film makes it difficult to perform heat-sealing across the strips for the purpose of closing and sealing the bags.

Various solutions have been proposed in attempts to overcome that difficulty.

The solution in most widespread use consists in hot pinching the strips together at intervals prior to feeding them to the assembly station. The intervals correspond to the pitch of the bags and the pinches are located in zones that are intended to coincide with the transverse heat-sealing. Such prior pinching also has the advantage of fixing the complementary strips together prior to fixing them to the film.

Such a solution is described, for example, in the following documents: FR-2 778 362, U.S. Pat. Nos. 4,756,622, 5,024,537, EP-0 302 144, U.S. Pat. Nos. 5,092,831, 4,663,915, 5,215,380, 5,046,300, and 4,589,145.

Another technique consists in feeding strips in lengths that correspond to the pitch of the bags instead of feeding the closure strips in continuous form.

That technique is described, for example, in the following documents: FR-2 716 158, FR-2 707 251, and EP-0 528 721.

Nevertheless, that technique has not been widely successful industrially because of its complexity. Specifically it turns out to be very difficult to guide the strips in segment form rather than continuously.

Another solution has been proposed in an attempt to eliminate the drawbacks of all of the means mentioned above. For example, document U.S. Pat. No. 4,876,842 describes an example consisting in detecting any lack of synchronization between the film and the closure strips and in acting on the drive thereof so as to resynchronize the film and the strips.

That technique is promising in theory, but it too has not had the expected industrial development, specifically because of its complexity, and due to relatively poor reliability.

OBJECTS AND SUMMARY OF THE INVENTION

The present invention now has the object of proposing novel means enabling the drawbacks of the prior art to be eliminated, and thus of proposing performance that is better than that in the known prior art.

In the context of the present invention, this object is achieved by a method of manufacturing bags that include complementary closure strips, the method comprising the steps consisting in:

separately feeding a film and closure strips having sequential thin zones at the same pitch as the bags; and fixing the strips to the film;

the method further comprising the steps consisting in:

detecting loss of synchronization between the closure strips and means acting in the assembly station; and in the event of loss of synchronization being detected, modifying the size of the sequential thin zones provided in the strips so as to reestablish synchronization.

More precisely, in the context of the invention, the detection means can detect loss of synchronization between the closure strips and the film, and/or loss of synchronization between the closure strips and means that are used for heat-sealing across the closure strips, at least in part, e.g. means for making a transverse line of heat-sealing.

The present invention also provides a machine for implementing the above-specified methods, and bags obtained thereby.

BRIEF DESCRIPTION OF THE DRAWING

Other characteristics, objects, and advantages of the present invention will appear on reading the following detailed description given with reference to the accompanying drawing showing non-limiting examples, and in which.

MORE DETAILED DESCRIPTION

Figure 1:
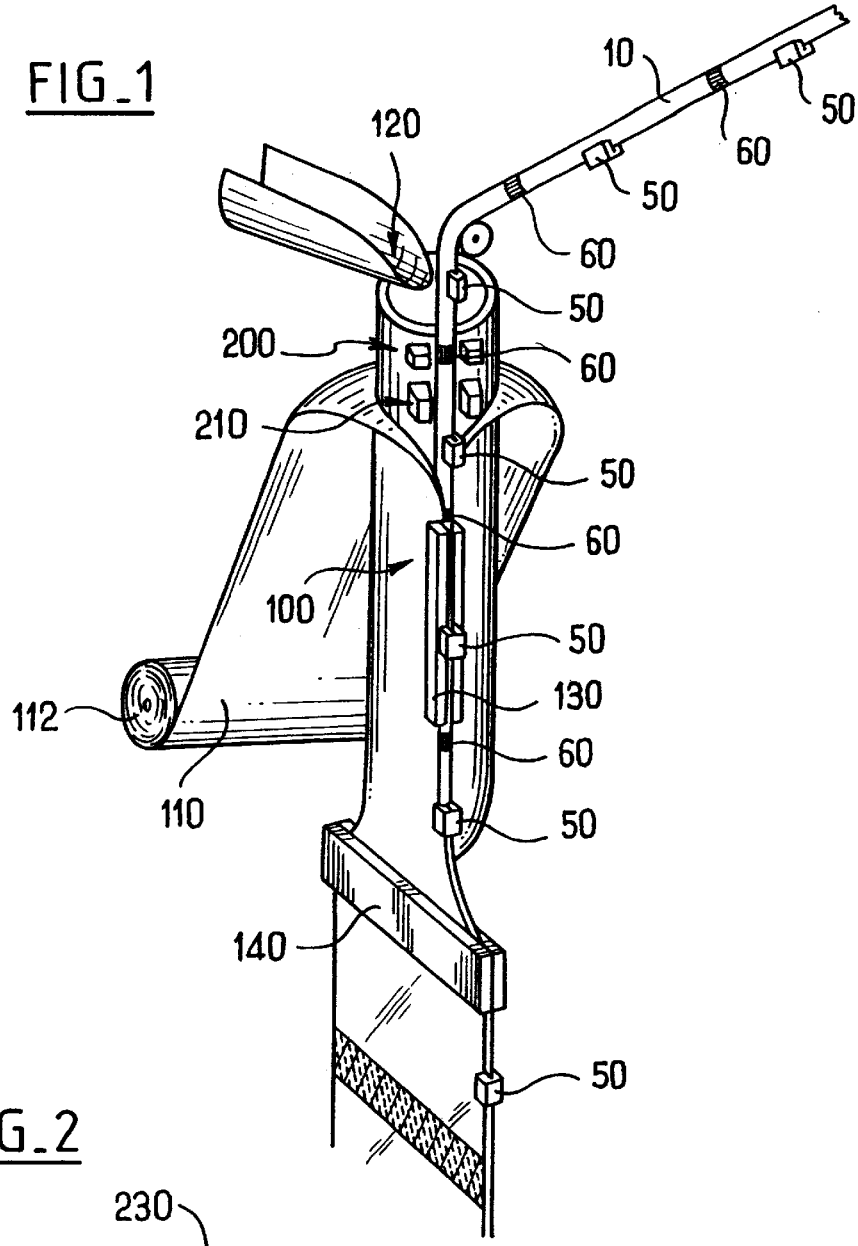
FIG. 1 is a diagrammatic perspective view of a machine suitable for implementing the invention, and constituting a preferred embodiment thereof.

Accompanying FIG. 1 shows an assembly station which receives both complementary closure strips 10 and a film 110. The strips 10 and the film 110 come from separate sources or supplies, such as a roll given reference 112 for the film 110. The closure strips 10 are fixed to the film 110 in the assembly station.

Still more precisely, the assembly station shown in FIG. 1 constitutes a vertical form, fill, and seal (FFS) machine.

Such a machine is well known to the person skilled in the art and is therefore not described in detail below. Its purpose is to form, fill, and close bags.

Nevertheless, it is recalled that such a machine generally comprises a forming neck 100 which receives the incoming film 110 in the plane state from an unwinder 112, and delivering the film 110 shaped into a tube; a filler chute 120 opening out into the forming neck 100 and consequently into said tube; longitudinal heat-sealing means 130 for closing the tube longitudinally (and preferably also for fixing the closure strips 10 to the film 110); and means 140 suitable for sequentially generating a first transverse line of heat-sealing before any product is introduced into the tube via the filler chute 120, and then a second transverse line of heat-sealing once the product has been introduced into the tube, so as to close a package around the product.

Naturally, the present invention is not limited to being applied to a vertical FFS type machine.

The invention is equally applicable to machines in which displacement takes place horizontally and not vertically.

Furthermore, the present invention is also applicable to machines designed solely for forming bags, without filling them, with filling being performed in a subsequent step.

Mention is made above of the possibility of using the means 130 that are provided for the purpose of closing the tube making up the bags also for the purpose of fixing the closure strips 10 onto the film 110. However, in the context of the present invention, the closure strips 10 can naturally be fixed onto the film 110 using any other appropriate means, independent of the means 130.

As mentioned above, the closure strips 10 used in the context of the present invention are preferably fitted with slides 50.

More precisely, the closure strip feed 10 has a regular sequence of slides 50 disposed at the same pitch as the bags.

The slides 50 are thus preferably premounted sequentially on the closure strips 10. Nevertheless, in a variant, provision could be made to use slides 50 that are designed to be fitted to the closure strips 10 in the assembly station, either before or after the closure strips 10 are secured to the film 110.

Reference can be made by way of example to documents EP-0 051 010, EP-0 102 301, and EP-0 479 661 for a description of means designed for feeding slides to the strips in an assembly station before or after the closure strips are secured to the film.

The structure of such slides 50 is well known to the person skilled in the art and is therefore not described in detail below.

Nevertheless, it is recalled that a slide 50 for co-operating with the closure strips 10 preferably comprises a soleplate having one face carrying two lateral flanges on either side of a central separator rib for the purpose of being received at least in part between the two complementary closure strips, and co-operating with the flanges to define two passages that converge or diverge depending on the direction taken into consideration, and each serving to receive a respective one of the closure strips.

Furthermore, as mentioned above, closure strips of the present invention as fed to the assembly station include, sequentially and at the same pitch as the bags, zones 60 of reduced thickness.

These thin zones 60 are preferably constituted by sequential zones where the closure strips 10 have been hot pinched together. Such previously hot pinched zones correspond to spots that have been clamped between jaws that are heated both to flatten the closure strips, thereby locally reducing the thickness thereof, and also to join the two complementary closure strips together at intervals.

The description below also mentions other variant sequential zones of small thickness in accordance with the invention.

In the context of the present invention, the assembly station is provided with means given reference 200 for the purpose of detecting any loss of synchronization between the closure strips 10 and means that act within the assembly station (preferably the film 110 and/or transverse heat-sealing jaws 140).

In the context of the present invention, means referenced 210 are also provided for the purpose of responding to loss of synchronization being detected by the means 200 to modify the size of the sequential thin zones 60 so as to reestablish synchronization between the closure strips 10 and the reference (the film 110 and/or the jaws 140).

The means 200 for detecting loss of synchronization can be implemented in a wide variety of ways. They are preferably constituted by optical cells or by mechanical feelers situated at a measured and known fixed distance from the means 140 that make the transverse lines of heat-sealing. The detection means 200 are adapted to detect the thin zones 60, or to detect some other identified marker on the closure strips 10 and situated at a known distance from the thin zones 60, so as to be able to verify that the thin zones 60 are synchronized with the film 110 and also with the means 140 that perform transverse heat-sealing.

The means 210 can also be adapted to ensure synchronization relative to references or marks applied to the film 110. For this purpose, it is possible to provide auxiliary detector means suitable for reading marks or references provided on the film 110.

The means 210 designed to modify the size of the thin zones can themselves be implemented in various ways.

In a first embodiment, the thin zones 60 correspond to preheated zones made sequentially on the closure strips 10. Under such circumstances, the means 210 are preferably constituted by means adapted to modify the size of the thin zones 60 by localized application of additional heat (upstream or downstream from the initial heated spot depending on the direction in which synchronization has been found to be defective).

In this context, the means 210 can be formed by heater jaws adapted to clamp onto the closure strips 10 on command.

In another embodiment, the means 210 can operate by partially cutting or milling the strips 10.

In a second variant of the invention, the thin zones 60 can be constituted by zones in which the closure strips are cut through in part. Reference can be made for example to document EP-A-0 620 105 which describes how such localized cuts can be formed in at least one of the closure strips.

Under such circumstances, the means 210 are preferably formed by cutting or milling means adapted to increase the size of the cut zone which corresponds to the thin zone.

In another embodiment, the means 210 can operate by applying heat to the strips 10.

In a third variant in accordance with the invention, the thin zones 60 are formed by prior application of heat or cuts as mentioned above, and provision is made as shown in FIG. 2 for the closure strips 10 to have a series of notches 230 in these zones 60 that are designed to allow the thin zone 60 to be lengthened by applying traction to the closure strips 10 in the longitudinal direction.

For this purpose, at least two notches 230 are provided in the thin zones 60 so as to open out to opposite longitudinal sides of the closure strips 10.

More precisely, and preferably, three notches 230 are thus provided which open out in alternation to the two opposite sides of the closure strips 10 (i.e. two notches 230 opening out to a first side of the closure strips 10 and an intermediate notch 230 between the first two above-mentioned notches opening out to a second longitudinal side of the closure strips 10).

Figure 2:
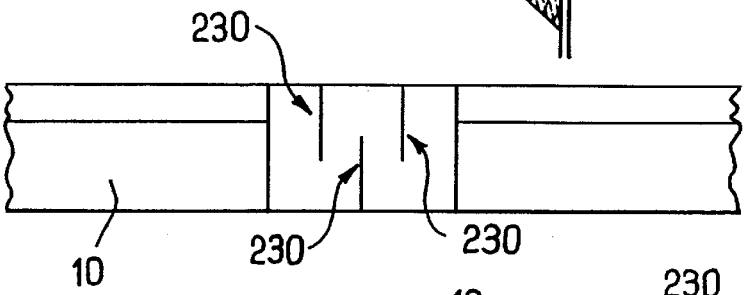
FIG. 2 is a plan view of a closure strip constituting an advantageous embodiment of the present invention, and including a series of notches.
Figure 3:
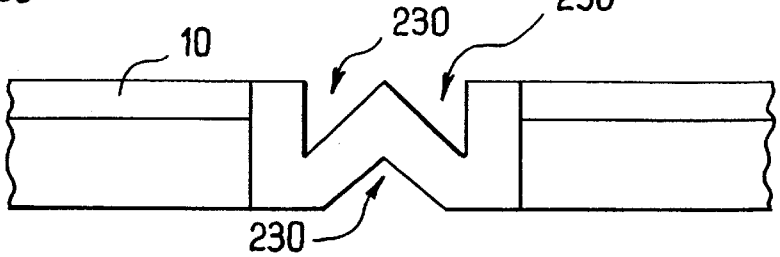
FIG. 3 is a view similar to FIG. 2 showing the potential for elongation of a thin zone obtained in the context of the present invention and using the notched variant.

As can be seen on comparing FIGS. 2 and 3, persons skilled in the art will readily understand that when the traction force exerted on the thin zones 60 exceeds a threshold, then the notches 230 open out because the strip material becomes deformed, thereby causing the zones 60 to be lengthened.

Typically, the notches 230 are made through the entire thickness of the closure strips 10 and the depth of the notches is greater than half the width of the strips 10.

An assembly comprising belts and/or wheels can thus constitute the means 210 which serve in this way to lengthen the thin zones 60 by modifying the traction force that is applied to the closure strips 10. Where appropriate, such belt and/or wheel assemblies can be themselves associated with heater jaws in order to lock the zones 60 in the state they take up after such lengthening has been imparted.

Naturally, the present invention is not limited to the particular embodiments described above, but on the contrary it extends to any variant within the spirit of the invention.

In particular, the present invention extends to any type of closure strip 10, in particular to assemblies comprising two complementary strips, a male strip and a female strip, or indeed to assemblies of closure strips based on hooks.

The present invention likewise applies to any type of film, whether the film is a single layer or a multiple layer thermoplastic material film, a paper film associated with at least one layer of plastics material, or indeed a metal-coated film, or any other equivalent film.

What is claimed is:

1. A method of manufacturing bags, including complementary closure strips, the method comprising:

separately feeding a film and closure strips having sequential thin zones at the same pitch as the bags;

fixing the strips to the film;

detecting loss of synchronization between a reference on the closure strips and a reference on the film; and in the event of loss of synchronization being detected, modifying the elongation of the sequential thin zones provided in the strips for a length corresponding to loss of synchronization detected so as to reestablish synchronization.

2. A method according to claim 1, wherein the thin zones correspond to zones of prior application of heat.

3. A method according to claim 1, wherein the thin zones correspond to zones where the closure strips have been cut through in part.

4. A method according to claim 1, wherein the step of modifying elongation comprises selectively applying additional heat.

5. A method according to claim 1, wherein the step of modifying elongation comprises selectively applying additional cutting or milling to the closure strips.

6. A method according to claim 1, wherein the closure strips include at least one notch opening out to a side edge of the closure strips, and the step of modifying elongation comprises applying traction to the closure strips to lengthen the thin zone by opening the notch.

7. A method according to claim 6 wherein the notch(es) is/are formed to the thin zone, which zone comprises a spot where heat has previously been applied to the closure strips or where they have been cut through in part.

8. A method according to claim 6, wherein at least two notches are provided opening out to opposite sides of the closure strips.

9. A method according to claim 6, wherein at least three notches are provided opening out alternately to opposite sides of the closure strips.

10. A method according to claim 6, wherein each notch extends over the entire thickness of the closure strips and is of depth greater than half the width thereof.

11. A method according to claim 6, comprising the further step of locking the notch(es) in the open state, by, optionally, applying heat.

12. A method of manufacturing bags, including complementary closure strips, the method comprising:

separately feeding a film and closure strips having sequential thin zones at the same pitch as the bags;

fixing the strips to the film;

detecting loss of synchronization between a reference on the closure strips and means for providing lines of heat-sealing that cross the closure strips; and in the event of loss of synchronization being detected, modifying the elongation of the sequential thin zones provided in the strips so as to reestablish synchronization.

13. A method according to claim 12, wherein the thin zones correspond to zones of prior application of heat.

14. A method according to claim 12, wherein the thin zones correspond to zones where the closure strips have been cut through in part.

15. A method according to claim 12, wherein the step of modifying elongation comprises selectively applying additional heat.

16. A method according to claim 12, wherein the step of modifying elongation comprises selectively applying additional cutting or milling to the closure strips.

17. A method according to claim 12, wherein the closure strips include at least one notch opening out to a side edge of the closure strips, and the step of modifying elongation comprises applying traction to the closure strips to lengthen the thin zone by opening the notch.

18. A method according to claim 17, wherein the notch (es) is/are formed to the thin zone, which zone comprises a spot where heat has previously been applied to the closure strips or where they have been cut through in part.

19. A method according to claim 17, wherein at least two notches are provided opening out to opposite sides of the closure strips.

20. A method according to claim 17, wherein at least three notches are provided opening out alternately to opposite sides of the closure strips.

21. A method according to claim 17, wherein each notch extends over the entire thickness of the closure strips and is of depth greater than half the width thereof.

22. A method according to claim 17, comprising the further step of locking the notch(es) in the open state by, optionally, applying heat.

23. A method of manufacturing bags, including complementary closure strips, the method comprising:

separately feeding a film and closure strips having sequential thin zones at the same pitch as the bags;

fixing the strips to the film;

detecting loss of synchronization between the closure strips and the film; and in the event of loss of synchronization being detected, modifying the elongation of the sequential thin zones provided in the strips so as to reestablish synchronization, wherein the step of modifying elongation comprises selectively applying additional heat.

24. A method according to claim 23, wherein the thin zones correspond to zones of prior application of heat.

25. A method according to claim 23, wherein the thin zones correspond to zones where the closure strips have been cut through in part.

26. A method of manufacturing bags, including complementary closure strips, the method comprising:

separately feeding a film and closure strips having sequential thin zones at the same pitch as the bags;

fixing the strips to the film;

detecting loss of synchronization between the closure strips and the film; and in the event of loss of synchronization being detected, modifying the elongation of the sequential thin zones provided in the strips so as to reestablish synchronization, wherein the step of modifying elongation comprises selectively applying additional cutting or milling to the closure strips.

27. A method according to claim 26, wherein the thin zones correspond to zones of prior application of heat.

28. A method according to claim 26, wherein the thin zones correspond to zones where the closure strips have been cut through in part.

29. A method of manufacturing bags, including complementary closure strips, the method comprising:

separately feeding a film and closure strips having sequential thin zones at the same pitch as the bags;

fixing the strips to the film;

detecting loss of synchronization between the closure strips and the film; and in the event of loss of synchronization being detected, modifying the elongation of the sequential thin zones provided in the strips so as to reestablish synchronization, wherein the closure strips include at least one notch opening out to a side edge of the closure strips, and the step of modifying elongation comprises applying traction to the closure strips to lengthen the thin zone by opening the notch.

30. A method according to claim 29, wherein the thin zones correspond to zones of prior application of heat.

31. A method according to claim 29, wherein the thin zones correspond to zones where the closure strips have been cut through in part.

32. A method according to claim 29, wherein the notch (es) is/are formed to the thin zone, which zone comprises a spot where heat has previously been applied to the closure strips or where they have been cut through in part.

33. A method according to claim 29, wherein at least two notches are provided opening out to opposite sides of the closure strips.

34. A method according to claim 29, wherein at least three notches are provided opening out alternately to opposite sides of the closure strips.

35. A method according to claim 29, wherein each notch extends over the entire thickness of the closure strips and is of depth greater than half the width thereof.

36. A method according to claim 29, comprising the further step of locking the notch(es) in the open state by, optionally, applying heat.

37. A method of manufacturing bags, including complementary closure strips, the method comprising:

separately feeding a film and closure strips having sequential thin zones at the same pitch as the bags;

fixing the strips to the film;

detecting loss of synchronization between the closure strips and means for providing lines of heat-sealing that cross the closure strips; and in the event of loss of synchronization being detected, modifying the elongation of the sequential thin zones provided in the strips so as to reestablish synchronization, wherein the step of modifying elongation comprises selectively applying additional heat.

38. A method according to claim 37, wherein the thin zones correspond to zones of prior application of heat.

39. A method according to claim 37, wherein the thin zones correspond to zones where the closure strips have been cut through in part.

40. A method of manufacturing bags, including complementary closure strips, the method comprising:

separately feeding a film and closure strips having sequential thin zones at the same pitch as the bags;

fixing the strips to the film;

detecting loss of synchronization between the closure strips and means for providing lines of heat-sealing that cross the closure strips; and in the event of loss of synchronization being detected, modifying the elongation of the sequential thin zones provided in the strips so as to reestablish synchronization, wherein the step of modifying elongation comprises selectively applying additional cutting or milling to the closure strips.

41. A method according to claim 40, wherein the thin zones correspond to zones of prior application of heat.

42. A method according to claim 40, wherein the thin zones correspond to zones where the closure strips have been cut through in part.

43. A method of manufacturing bags, including complementary closure strips, the method comprising:

separately feeding a film and closure strips having sequential thin zones at the same pitch as the bags;

fixing the strips to the film;

detecting loss of synchronization between the closure strips and means for providing lines of heat-sealing that cross the closure strips; and in the event of loss of synchronization being detected, modifying the elongation of the sequential thin zones provided in the strips so as to reestablish synchronization, wherein the closure strips include at least one notch opening out to a side edge of the closure strips, and the step of modifying elongation comprises applying traction to the closure strips to lengthen the thin zone by opening the notch.

44. A method according to claim 43, wherein the thin zones correspond to zones of prior application of heat.

45. A method according to claim 43, wherein the thin zones correspond to zones where the closure strips have been cut through in part.

46. A method according to claim 43, wherein the notch (es) is/are formed to the thin zone, which zone comprises a spot where heat has previously been applied to the closure strips or where they have been cut through in part.

47. A method according to claim 43, wherein at least two notches are provided opening out to opposite sides of the closure strips.

48. A method according to claim 43, wherein at least three notches are provided opening out alternately to opposite sides of the closure strips.

49. A method according to claim 43, wherein each notch extends over the entire thickness of the closure strips and is of depth greater than half the width thereof.

50. A method according to claim 43, comprising the further step of locking the notch(es) in the open state by, optionally, applying heat.

* * * * *

UNITED STATES PATENT AND TRADEMARK OFFICE

CERTIFICATE OF CORRECTION

PATENT NO. : 6,740,019 B2
DATED : May 25, 2004
INVENTOR(S) : Henri Georges Bois

It is certified that error appears in the above-identified patent and that said Letters Patent is hereby corrected as shown below:

Title page,
Item [54], Title, after "STRIPS" delete ", A MANUFACTURING MACHINE, AND BAGS OBTAINED THEREBY".

Column 5,
Line 52, "claim 6" should read -- claim 6, --.

Column 6,
Lines 29-30, "notch (es)" should read -- notch(es) --.

Column 7,
Lines 37-38, "notch (es)" should read -- notch(es) --.

Column 8,
Lines 50-51, "notch (es)" should read -- notch(es) --.

Signed and Sealed this

Twentieth Day of July, 2004

JON W. DUDAS
*Acting Director of the United States Patent and Trademark Office*